US012138527B2

(12) United States Patent
Vaioli

(10) Patent No.: US 12,138,527 B2
(45) Date of Patent: Nov. 12, 2024

(54) BOWLING CENTER SYSTEM

(71) Applicant: QUBICAAMF WORLDWIDE, LLC, Mechanicsville, VA (US)

(72) Inventor: Roberto Vaioli, Ozzano dell'Emilia (IT)

(73) Assignee: QUBICAAMF WORLDWIDE, LLC, Mechanicsville, VA (US)

( * ) Notice: Subject to any disclaimer, the term of this patent is extended or adjusted under 35 U.S.C. 154(b) by 0 days.

(21) Appl. No.: 18/212,267

(22) Filed: Jun. 21, 2023

(65) Prior Publication Data

US 2024/0139610 A1 May 2, 2024

(51) Int. Cl.
*A63D 5/08* (2006.01)

(52) U.S. Cl.
CPC ..... *A63D 5/08* (2013.01)

(58) Field of Classification Search
CPC ..... A63D 5/08; A63D 5/09
See application file for complete search history.

(56) References Cited

U.S. PATENT DOCUMENTS 3,073,596 A * 1/1963 Eyre ..... A63D 5/08 473/81
3,458,191 A * 7/1969 Pennebaker ..... A63D 5/08 473/81

(Continued)

FOREIGN PATENT DOCUMENTS

EP 3348310 7/2018
EP 3348310 A1 * 7/2018 ..... A63D 5/08
WO 2015140142 9/2015

OTHER PUBLICATIONS

Search Report and Written Opinion issued on Apr. 28, 2023 in corresponding Application No. IT102022000022065, 9 pages.

*Primary Examiner* — William M Pierce
(74) *Attorney, Agent, or Firm* — Andrew M. Calderon; Calderon Safran & Wright P.C.

(57) ABSTRACT

A bowling centre system (100) comprises: a bowling lane (1); a plurality of pins (2) positionable at predetermined points on the bowling lane (1); a plurality of strings (3), associated at one end, with a corresponding pin (2); for each string (3), a constrain system (4) positioned above the bowling lane (1) and having the other end of each string (3) connected to it; a pulley system (5) for managing the strings (3), positioned between the connecting system (4) and the pins (2) and comprising a motor-driven drawbar (6) operatively configured to manage a predetermined length of each string (3) present along the pulley system (5); the drawbar (6) is movable between a first position, allowing the pins (2) to be lifted from the bowling lane (1), and a second position, allowing not only the pins (2) to be lowered onto the bowling lane (1) into the predetermined position but also each string (3) to be slackened by the release of a further first working length so that the pins (2) can fall freely when struck by a ball (7) thrown along the lane (1) or by other pins struck by the ball (7) during play; a control device (8) for controlling the position of the movable drawbar (6); and a drive and selection system (9) connected to the movable drawbar (6) and to the control device (8) and configured to allow the movable drawbar (6) to move, when required, to at least a further, third operating position allowing the string (3) to be slackened by the release of a second working length different from the first working length of string (3) released when the second operating position is reached.

19 Claims, 5 Drawing Sheets

(56) References Cited

U.S. PATENT DOCUMENTS

| | | | | | |
|---|---|---|---|---|---|
| 3,480,279 | A * | 11/1969 | Ingebo | A63D 5/08 | 473/82 |
| 3,778,057 | A * | 12/1973 | Leidl | A63D 5/08 | 473/81 |
| 5,167,412 | A * | 12/1992 | Rochefort | A63D 5/08 | 473/78 |
| 9,180,360 | B2 * | 11/2015 | De Lange | A63D 5/08 | |
| 10,300,366 | B2 * | 5/2019 | Di Dio | A63D 5/08 | |
| 2018/0147479 | A1 * | 5/2018 | Di Dio | A63D 5/08 | |

* cited by examiner

BOWLING CENTER SYSTEM

This invention relates to a bowling centre system.

More specifically, this invention addresses bowling centres having one or more bowling lanes, each provided with a string system (string pinspotter) for recovering and setting the pins back in their original positions on the lane.

At present, every bowling centre system is provided with a pinspotter for automatically setting fallen pins back in position on the bowling lane.

These automatic systems can be classified into two types: free fall systems (without string) and string system (with string).

This specification refers to bowling centre systems with string pinspotters.

A system of this kind comprises the following, at an end zone of the bowling lane:

- a plurality of pins which can be positioned at predetermined points on a bowling lane;
- a plurality of strings, each associated at one end, with a corresponding pin;
- for each string, a constrain system positioned above the bowling lane and having the other end of each string connected to it;
- a pulley system for managing the strings and positioned between the constrain system and the pins; the system also comprises a motor-driven drawbar, movable along a predetermined path, operatively configured to control (in the sense of making available) the working length of each string present along the path of the drawbar; the drawbar is movable between a first position to allow the pins to be lifted from the bowling lane (in order to stabilize the pins), and a second position to allow not only the pins to be lowered onto the bowling lane into the predetermined position but also each string present along the path to be slackened by the release of a further working length to let the pins move during play (that is, leaving a good amount of slack string to allow the pins to fall and move freely when struck). In other words, the drawbar is, for the strings, a modifiable connecting point configured to give the string, in particular when it reaches the above mentioned second position, a predetermined amount of slack along its path, so that the pin can fall and move freely.

A bowling centre system with a structure of this kind has some drawbacks, however.

The second position that the drawbar can adopt is factory set by the manufacturer at the time of production.

If the second position of the drawbar defines a very long working length of string, the falling/pushing movements of the pins during play may cause the strings of two or more pins to become so inextricably entangled that when the pins are lifted, the strings remain knotted to each other, bringing the pinspotter to a stop until a member of the bowling centre staff comes to disentangle them. This dampens the fun of playing, reduces the efficiency of the system and results in a negative economic impact for the owner of the bowling centre.

The effect of this drawback is made even worse if the ball is thrown with great force, as in the case, for example, of pro-bowlers, where the ball impact of the ball at a higher speed and with a spin may cause the pins to be scattered over a larger area, increasing the risk of the pin strings becoming entangled.

On the other hand, if the second position of the drawbar defines a relatively short working length of string, the string may alter the result of a throw, for example by a pro-bowlers (compared to the case where the string left slack is longer) and may increase the difference in behaviour compared to system with automatic free fall pinspotters.

A pro-bowler is used to throwing a ball with precision and a special spin or twist so that it strikes one or more pins in a desired manner and can in turn knock down other pins to obtain a clean strike, for example. This is normally the case in free fall pin systems.

The constraint created by a string with a reduced amount of slack might make a pin fall over with an "unnatural" movement compared to the movement of pin knocked over in a free fall system, since the string may limit the movement of the pin even just by contact between the string and a part of the pulley system.

This invention has for an aim to provide a bowling centre system that overcomes the abovementioned drawbacks of the prior art.

More specifically, the aim of this invention is to provide a bowling centre system capable of reducing machine shutdowns due to entanglement of the strings during play.

Another aim of this invention is to propose a bowling centre system capable of improving performance and operating flexibility even during matches played by pro-bowlers.

These aims are fully achieved by a bowling centre system according to this invention as characterized in the appended claims.

The main features of the invention will become more apparent from the following detailed description of a preferred, non-limiting embodiment of it, illustrated by way of example in the accompanying drawings, in which.

Figure 1:
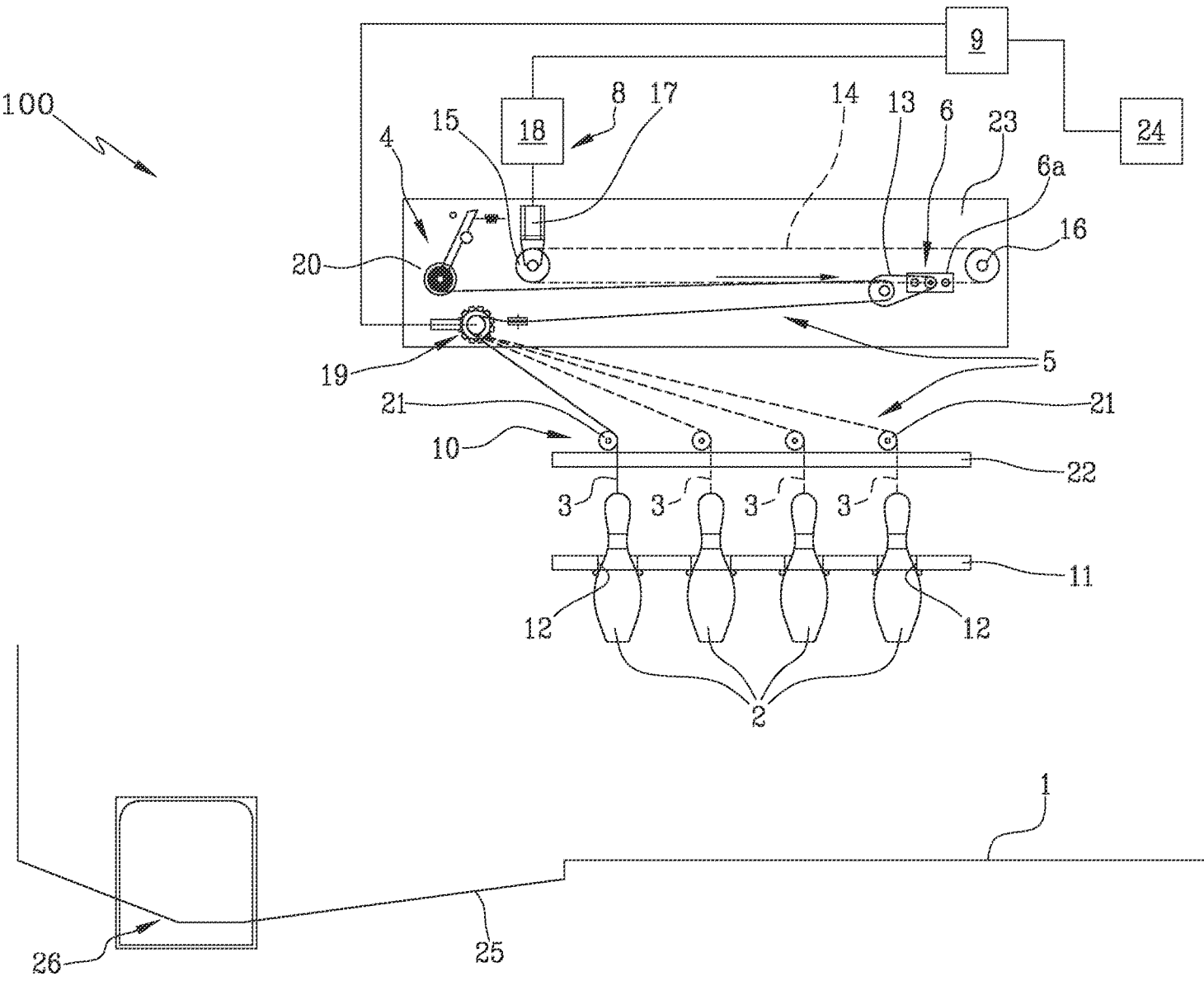
FIG. 1 illustrates the bowling centre system of this invention in a configuration for stabilizing the pins, the drawing being a schematic side view with some parts cut away to better illustrate others.
Figure 2:
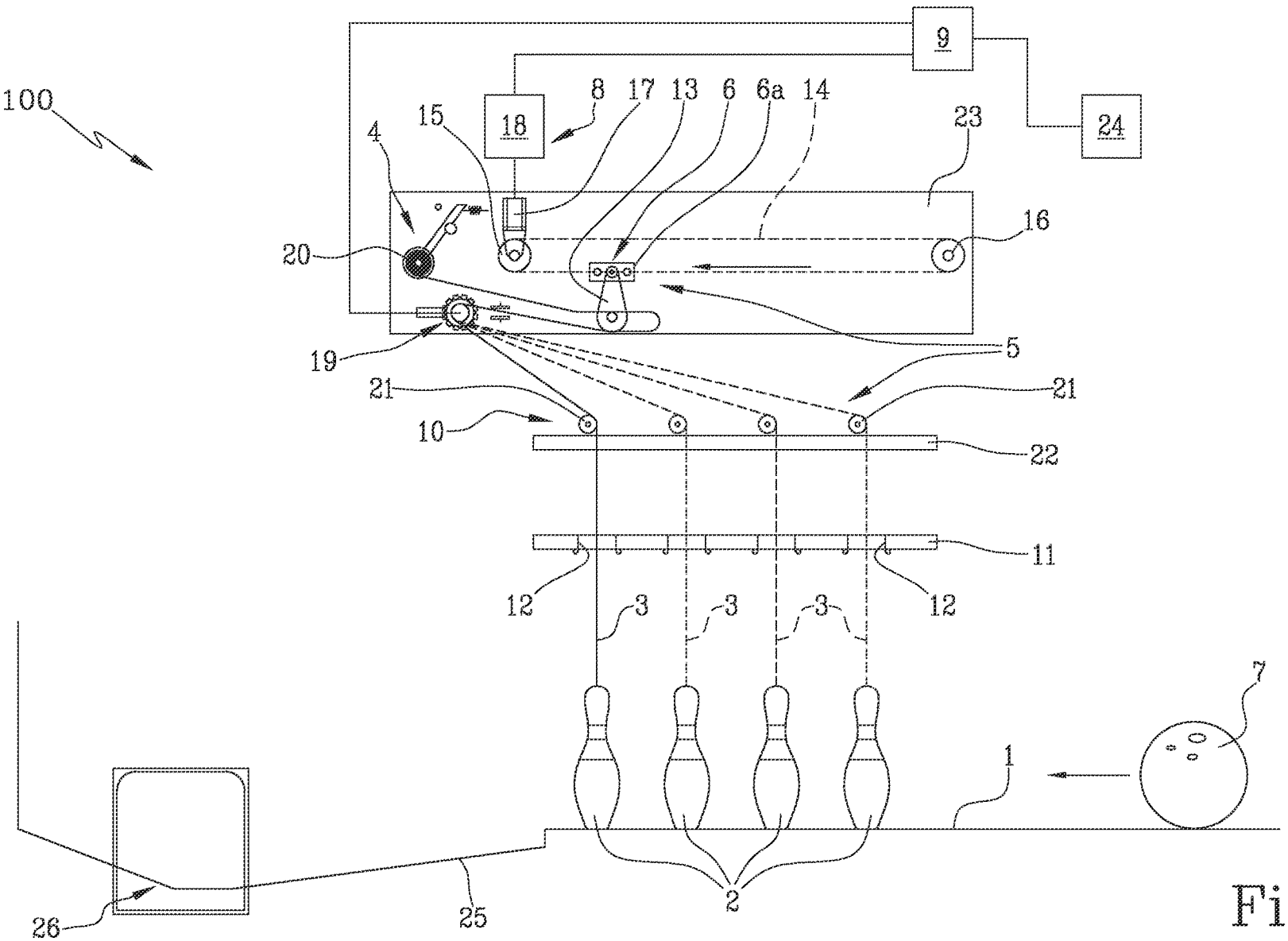
FIG. 2 illustrates the bowling centre system of this invention in a first configuration, with the pins being positioned on the lane and the string slackened by the release of a first working length of string, the drawing being a schematic side view with some parts cut away to better illustrate others.
Figure 4:
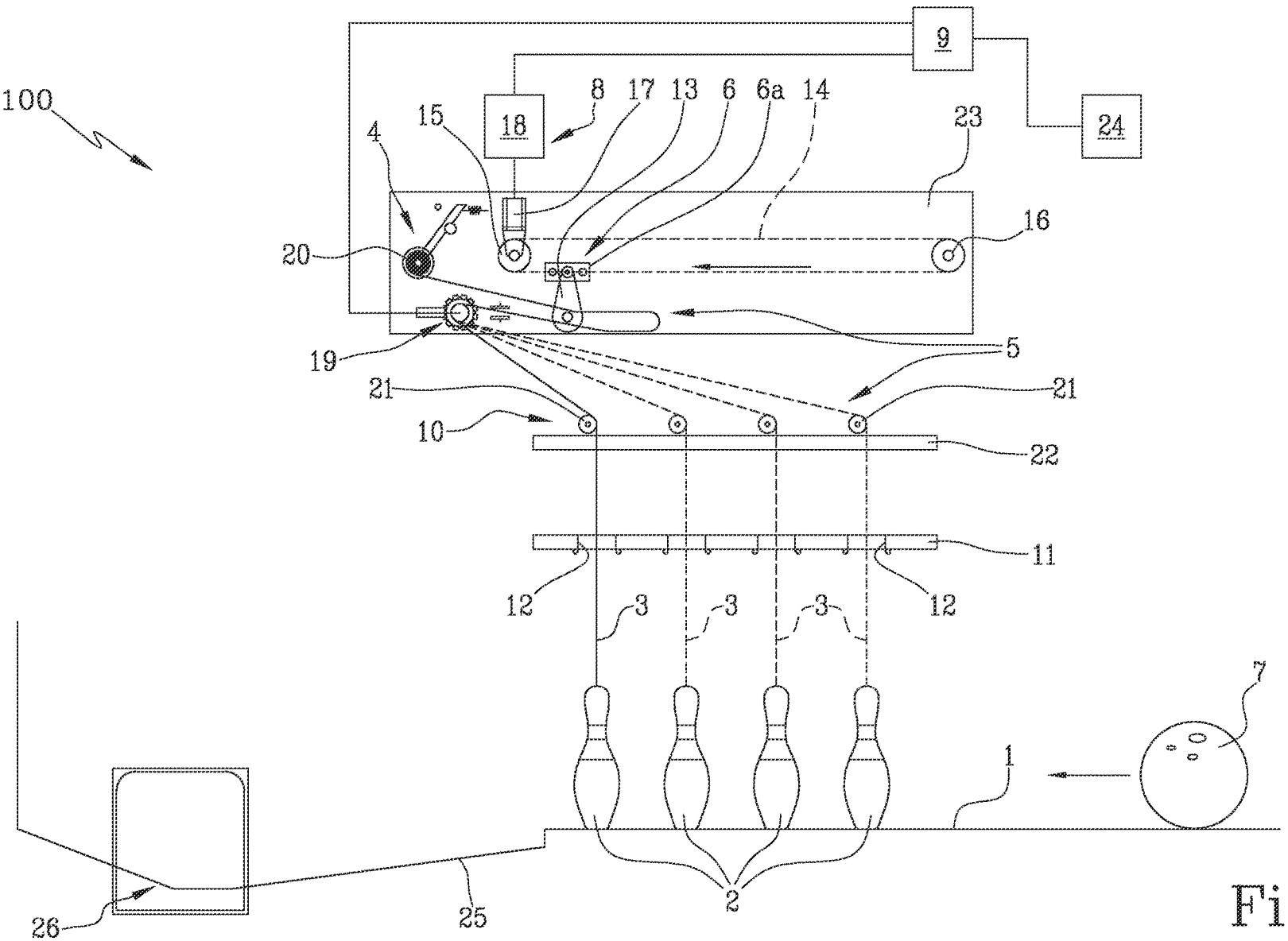
FIG. 4 illustrates the bowling centre system of this invention in a second configuration, with the pins being positioned on the lane and the string slackened by the release of a second working length of string, the drawing being a schematic side view with some parts cut away to better illustrate others.
Figure 5:
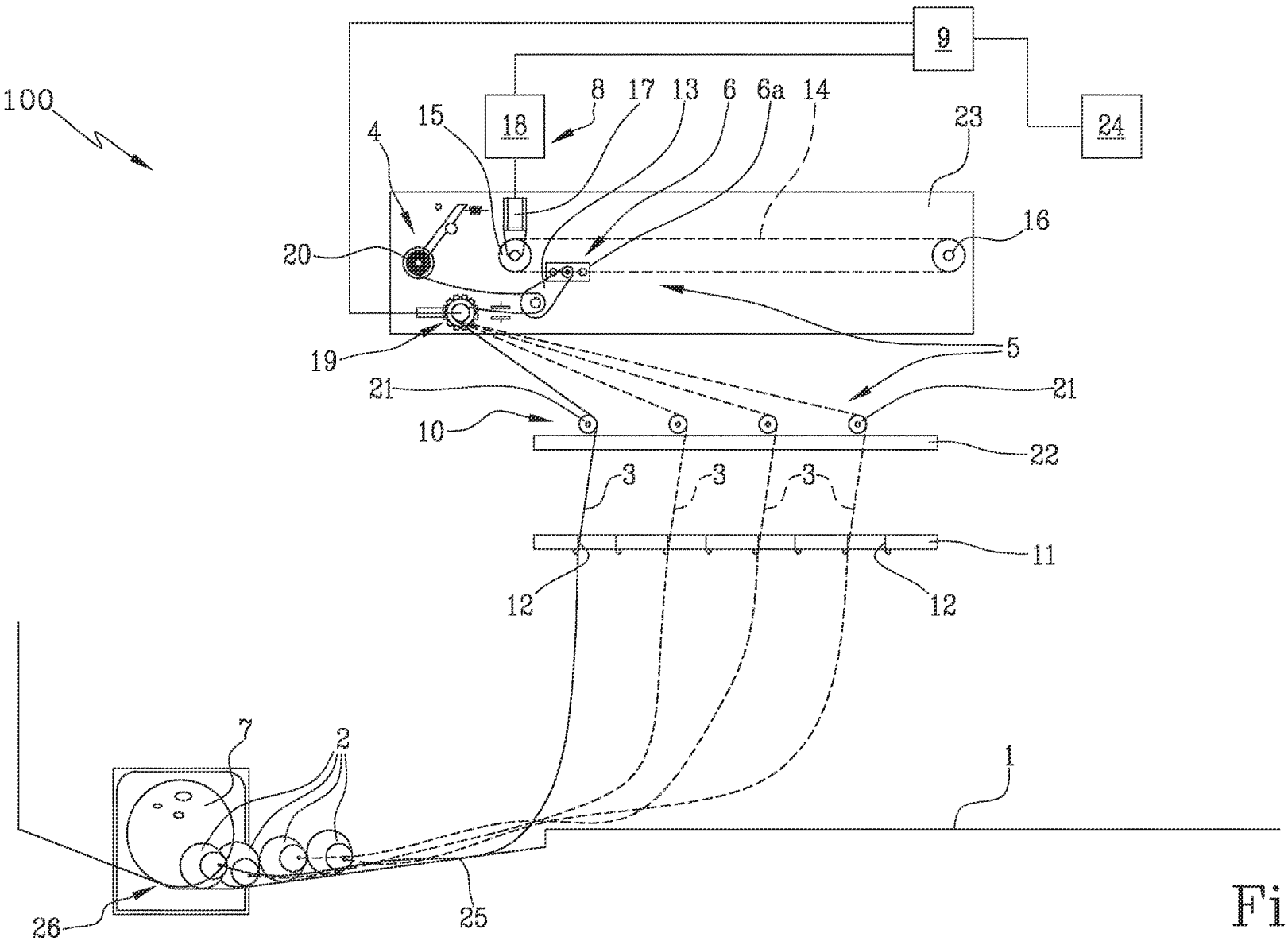
FIG. 5 illustrates the bowling centre system of this invention in a second configuration, with the pins knocked down and the string slackened by the release of the second length of string, the drawing being a schematic side view with some parts cut away to better illustrate others.

With reference to the accompanying drawings, in particular FIGS. 1, 2 and 4, the invention relates to a bowling centre system, denoted in its entirety by the numeral 100.

In this specification, the term "bowling centre system" is used to mean a single structure which may be one of a plurality of similar single structures in a games hall.

The bowling centre system 100 comprises a bowling lane 1.

The bowling centre system 100 comprises a plurality of pins 2 positionable at predetermined points on the bowling lane 1 (at one end of the bowling lane 1).

By way of non-limiting example, the accompanying drawings show four pins but the number of pins in the bowling centre system may be higher, usually ten.

The bowling centre system 100 further comprises a plurality of strings 3, associated at one end, with a corresponding pin 2.

The bowling centre system 100 further comprises, for each string 3, a constrain system or reel system 4 positioned above the bowling lane 1 and having the other end of each string 3 connected to it.

The bowling centre system 100 also comprises a pulley system 5 for the strings 3, positioned between the reel system 4 and the pins 2.

As illustrated, the pulley system 5 also comprises a motor-driven drawbar 6, movable along a predetermined path and operatively configured to manage a predetermined length of each string 3 present along the pulley system 5.

Figure 3:
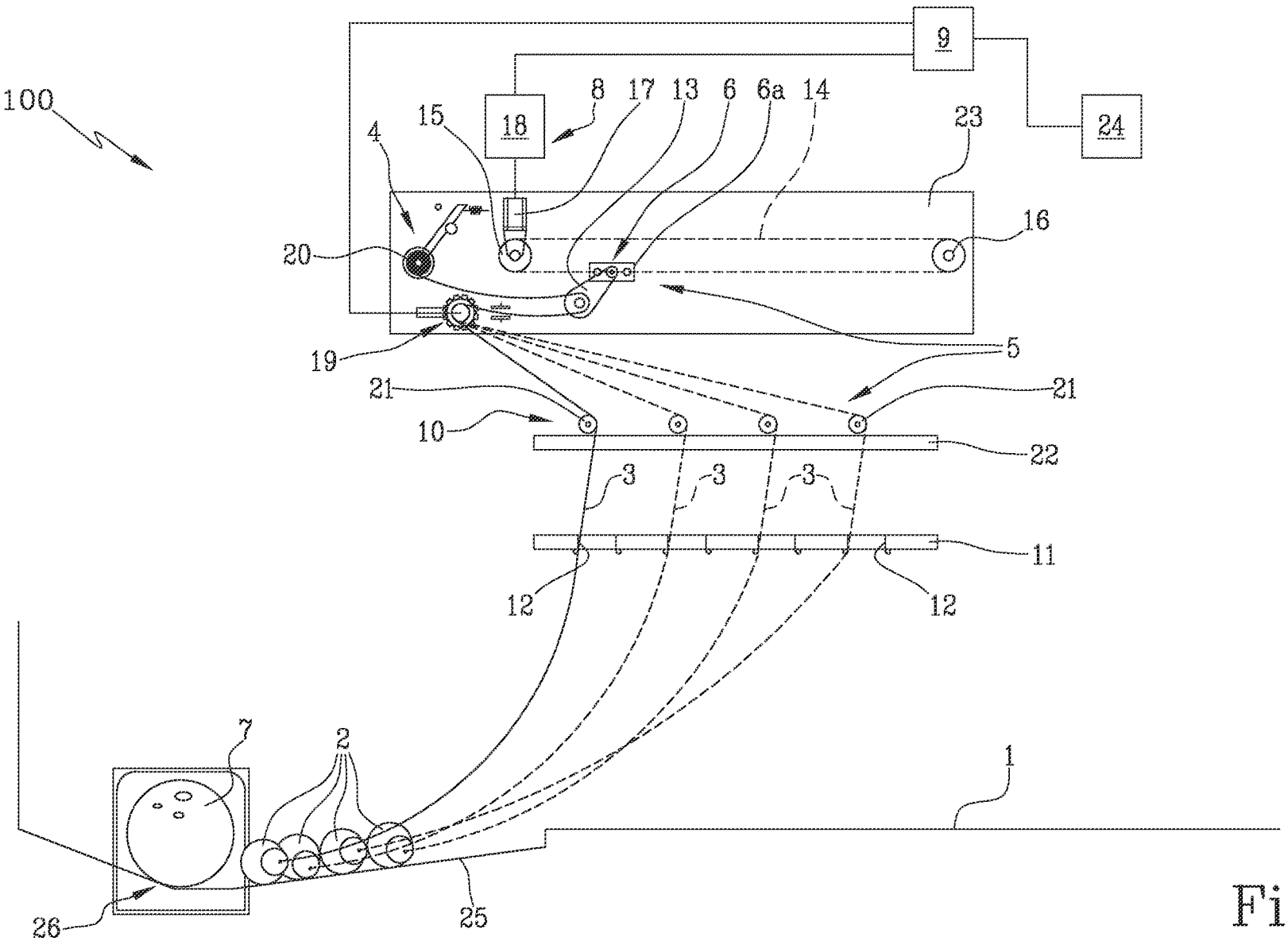
FIG. 3 illustrates the bowling centre system of this invention in a first configuration. with the pins knocked down and the string slackened by the release of the first length of string, the drawing being a schematic side view with some parts cut away to better illustrate others.

Also, as illustrated, the drawbar 6 is movable between:

- a first position, allowing the pins 2 to be lifted from the bowling lane 1 (see FIG. 1), and
- a second position, allowing not only the pins 2 to be lowered onto the bowling lane 1 into the predetermined position but also each string 3 to be slackened by the release of a further first working length of it, after the pins 2 have been positioned, so that the pins 2 can fall freely when struck by a ball 7 thrown along the lane 1 or by other pins struck by the ball 7 during play (for example, see FIGS. 2 and 3).

Also, as illustrated, the bowling centre system 100 comprises a control device 8 for controlling the position of the movable drawbar 6 along its path, hence also the length of string managed by the movable drawbar 6.

The bowling centre system 100 further comprises a control, drive and selection system (unit) 9 connected to the movable drawbar 6 and to the control device 8 and configured to allow the movable drawbar 6 to move, when required, to at least a third operating position allowing the string 3 to be slackened by the release of a further, second working length different from the first working length of string 3 released when the second operating position is reached.

This control, drive and selection system 9 may be manual, mechanical or electronic/computerized, depending on the choices of the constructor of the bowling centre system 100.

In other words, the bowling centre system of this invention is structured to be able to configure the release of the strings (in longer or shorter lengths) depending on what type of operating configuration is required by the bowling centre system on each occasion.

It should be noted that the bowling centre system 100 also comprises a zone for temporarily collecting the fallen pins 2 after a throw of the ball 7.

The zone comprises a collection pit 25, with inclined surfaces, formed at the far end of the lane 1. On one side of the pit 25, there is an opening 26 for removing the ball 7 from the lane 1.

In the case illustrated in FIG. 4 (purely by way of non-limiting example), the movable drawbar 6, on reaching the third position, releases a second working length of string 3, greater than the first length of string 3 released when the second position (shown in FIG. 2) is reached.

The operating release positions of the drawbar 6 may be more than the two described above without thereby limiting the scope of protection of this solution.

The above-mentioned pulley system 5 comprises a fixed pulley subsystem 10 for each string 3 disposed between the movable drawbar 6 and the pins 3.

The fixed pulley subsystem 10 is configured to allow each pin 2 to be positioned at the predetermined point of the bowling lane 1.

In light of this, the subsystem 10 may comprise a plurality of pulleys 21 (equal in number to the number of strings 3 present) connected to a supporting frame 22 and positioned above the lane 1.

Each pulley 21 is mounted, in height, at a position above the predetermined initial position which the respective pin 2 must have on the lane 1 below it. The bowling centre system 100 may also comprise a stabilizing board 11 positioned between the pins 2 and the movable drawbar 6.

The board 11 is provided with a plurality of openings 12, engageable by the corresponding pins 2 while they are being lifted into the first position, so as to stabilize the pins 2 before starting to lower them (position shown in FIG. 1).

As illustrated, the movable drawbar 6 is provided with a plurality of sheaves 13 for unreeling the strings 3 (the sheaves used are equal in number to the number of strings present in the system).

In light of this, the movable drawbar 6 is associated with an endless chain assembly 14 looped around a pair of pulleys 15, 16.

It should be noted that one of the pulleys 15 is connected to a drive motor unit 17 connected to the drive unit 9.

In a non-limiting constructional example, the chain assembly 14 is associated with a frame 23 mounted above the lane 1 so that the (horizontal) active section of it, on which the drawbar 6 runs, is parallel to the lane 1. Also connected to the frame 23 is the reel system 4 of the strings 3.

In light of this, the reel system 4 comprises a plurality of tensioning elements 20, independent of each other and each acting on a corresponding string 3. In light of this, the tensioning elements 20 are also configured to modify the total length of each string 3 available between the element 20 itself and the corresponding pin 2.

The drawbar 6 may be composed of a plate **6*a* associated with the active section of the chain 14 to which the sheaves 13 for unreeling the strings 3** are articulated.

Also, as illustrated, the drive motor unit 17 also comprises the control device 8 for controlling the position of the movable drawbar 6.

It should be noted that the control device 8 for controlling the position of the movable drawbar 6 is configured to measure and check the length of the string 3 managed by the drawbar 6 as it reaches the different positions along its predetermined path.

In light of this, the drive motor unit 17 may comprise a brushless motor with Hall effect sensor assemblies or probes 18 for controlling the position of the movable drawbar 6 and for measuring the length of string 3 managed by the movable drawbar 6.

The bowling centre system 100 may also comprise a control device 19 for checking the movement or sliding of the strings 3 and positioned between the movable drawbar 6 and the fixed pulley subsystem 10.

This device is configured for checking that the strings 3 effectively slide according to the movements of the movable drawbar 6.

Preferably, the control device 19 is connected to the drive unit 9.

In a constructional example, the control device 19 for checking the movement or sliding of the strings 3 comprises an optical encoder.

Preferably, the control device 19 for checking string movement or sliding is associated with the aforementioned frame 23.

As illustrated, the drive system is connected to a user; operator interface unit 24 from which it is possible to set/select options to define the second or third position in order to define the working length of string 3 to be made available for the pins 2.

Thanks to this type of system, the aforementioned aims of the invention are achieved by making it possible to have two different operating configurations for the working length of string for the pins.

When a pin is knocked down, a configuration with longer strings can make its behaviour more similar to that of a free fall system since the string does not excessively limit the behaviour of the falling pin (the pin can move and rebound freely within the end zone of the machine without the string limiting its movements).

A configuration with relatively shorter strings considerably reduces the risk of the strings frequently getting entangled with each other, even in the case of throws by pro-bowlers.

The invention claimed is:

1. A bowling centre system comprising at least:

a bowling lane;

a plurality of pins positionable at predetermined points on the bowling lane;

a plurality of strings, associated at one end, with a corresponding pin;

for each string, a constrain system positioned above the bowling lane and having the other end of each string connected to it;

a pulley system for the strings, positioned between the constrain system and the pins; the pulley system also comprises a motor driven drawbar, movable along a predetermined path and operatively configured to manage a predetermined length of each string present along the pulley system; the drawbar being movable between a first position of game preparation, allowing the pins to be lifted from the bowling lane, and a second operating game position, allowing not only the pins to be lowered onto the bowling lane into the predetermined position but also each string to be slackened by the release of a further first working length of it, after the pins have been positioned, so that the pins can fall freely when struck by a ball thrown along the lane or by other pins struck by the ball during play;

a control device for controlling the position of the movable drawbar along the predetermined path;

a control, drive and selection system connected to the movable drawbar and to the control device and configured to allow the movable drawbar to move, when required, to at least a third alternative operating game position to the second operating game position allowing the string to be slackened by the release of a further, second working length different from the first working length of string released when the second operating game position is reached.

2. The system according to claim 1, wherein the pulley system comprises a fixed pulley subsystem for each string disposed between the movable drawbar and the pins and configured to allow each pin to be positioned at the predetermined point of the bowling lane.

3. The system according to claim 1, comprising a stabilizing board positioned between the pins and the movable drawbar; the board being provided with a plurality of openings, engageable by the corresponding pins while they are being lifted into the first position, so as to stabilize the pins before starting to lower them.

4. The system according to claim 1, wherein the control device for controlling the position of the movable drawbar is configured to measure and check the length of the string managed by the drawbar.

5. The system according to claim 1, wherein the movable drawbar is provided with a plurality of sheaves for unreeling the strings; the movable drawbar being associated with an endless chain assembly looped around a pair of pulleys; one of the pulleys being connected to a drive motor unit connected to the drive unit to allow the drawbar to move along the predetermined path in both directions.

6. The system according to claim 5, wherein the drive motor unit also comprises the control device for controlling the position of the movable drawbar.

7. The system according to claim 5, wherein the drive motor unit comprises a brushless motor with Hall effect sensor assemblies or probes used for controlling the position of the movable drawbar.

8. The system according to claim 1, comprising a control device for checking the movement or sliding of the strings, positioned between the movable drawbar and the fixed pulley subsystem and configured for checking that the strings effectively slide according to the movements of the movable drawbar; the control device being connected to the drive unit.

9. The system according to claim 1, wherein the movable drawbar, on reaching the third alternative operating game position to the second operating game position, releases a second working length of string, greater than the first working length of string released when the second operating game position is reached.

10. The system according to claim 1, wherein the constrain system comprises a plurality of tensioning elements, independent of each other and each acting on a corresponding string; the tensioning elements being also configured to modify the total length of each string available between the element itself and the corresponding pin.

11. The system according to claim 8, wherein the control device for checking the movement or sliding of the strings comprises an optical encoder.

12. A bowling centre system comprising at least:

a plurality of pins positionable at predetermined points on a bowling lane;

a plurality of strings, associated at one end, with a corresponding pin of the plurality of pins;

a constrain system associated with each string;

a pulley system positioned between the constrain system and the pins, the pulley system comprising a drawbar movable along a predetermined path and operatively configured to manage a predetermined length of each string present along the pulley system;

a control device controlling the position of the movable drawbar along the predetermined path in a first operating position in which the pins are lifted from the bowling lane, a second operating position in which the pins are lowered onto the bowling lane and each string is slackened by a release of a first working length and a third operating position in which the string is further slackened; and a control, drive and selection system connected to the movable drawbar and to the control device and configured to allow the movable drawbar to move, when required, to the third operating position allowing the string to be slackened by release of the string from the first working length when the second operating position is reached.

13. The system according to claim 12, wherein the movable drawbar, on reaching the third operating position, releases a second working length of the string, greater than the first working length of the string released when the second operating position is reached.

14. The system according to claim 12, further comprising a stabilizing board positioned between the pins and the movable drawbar, the stabilizing board being provided with a plurality of openings engageable by the corresponding pins while they are being lifted into the first operating position.

15. The system according to claim 12, further comprising a plurality of tensioning elements, independent of each other and each acting on a corresponding string, the tensioning elements configured to modify a total length of each string.

16. The system according to claim 12, wherein the control device is configured to measure and check a length of the string managed by the movable drawbar as it reaches the different positions along the predetermined path.

17. The system according to claim 16, further comprising Hall effect sensor assemblies for controlling the position of the movable drawbar and for measuring the length of string 3 managed by the movable drawbar.

18. The system according to claim 12, further comprising a control device for checking movement or sliding of the strings and positioned between the movable drawbar 6 and the pulley systems.

19. The system according to claim 18, wherein the control device comprises an optical encoder.

* * * * *